United States Patent [19]

Eisert

[11] 4,162,819

[45] Jul. 31, 1979

[54] ELECTRICAL TERMINAL

[75] Inventor: Klaus Eisert, Blomberg, Fed. Rep. of Germany

[73] Assignee: Phönix Elektrizitätsgesellschaft H. Knümann & Co., Blomberg, Fed. Rep. of Germany

[21] Appl. No.: 889,434

[22] Filed: Mar. 23, 1978

[30] Foreign Application Priority Data

Mar. 26, 1977 [DE] Fed. Rep. of Germany ..... 2713494

[51] Int. Cl.[2] ..... H01R 9/10

[52] U.S. Cl. ..... 339/247; 339/270 R

[58] Field of Search ..... 339/247, 270

[56] References Cited

U.S. PATENT DOCUMENTS

| | | | |
|---|---|---|---|
| 2,007,357 | 7/1935 | Anderson et al. | 339/270 R |
| 3,290,641 | 12/1966 | Payne et al. | 339/270 R |
| 3,464,055 | 8/1969 | Lescarboura | 339/270 R |

FOREIGN PATENT DOCUMENTS

| | | | |
|---|---|---|---|
| 1123725 | 2/1962 | Fed. Rep. of Germany | 339/247 |
| 1080648 | 4/1970 | Fed. Rep. of Germany | 339/270 R |
| 1293102 | 4/1962 | France | 339/270 R |

*Primary Examiner*—Joseph H. McGlynn
*Attorney, Agent, or Firm*—Karl F. Ross

[57] ABSTRACT

A terminal device for connecting an electrical conductor to another unit, e.g. in the form of a terminal strip, comprises a passage for inserting the insulation-stripped end of the conductor which is inclined to another passage in which a clamping screw is received. The screw has a conical nonthreaded portion which bears against the conductor when the screw is tightened and where the passages meet.

10 Claims, 4 Drawing Figures

ELECTRICAL TERMINAL

FIELD OF THE INVENTION

The present invention relates to an electric terminal device or terminal strip of a type in which one or more conductors are anchored by respective screws for connection to another unit.

BACKGROUND OF THE INVENTION

In electrical devices it is known to provide terminals using a screw or like member to clamp the bared or insulation-stripped end of a conductor for connection to another electrical unit. Terminal strips of this type can accommodate a large number of conductors, e.g. 32, 48, 64 or 96, and can be provided for many purposes. For example, they are used in the electric-power field for the connection of conductors to circuit-breaker or fuse blocks or panels, for the connection of a plurality of lines to a single supply line, and for electric-current distribution in apparatuses of all types. In the electronics industry, such terminals may be used to connect wire conductors to block or jack systems, to the edge conductors of circuit boards or, in general, for current or signal distribution or collection in conjunction with a multiplicity of lines.

Terminal strips of the aforedescribed type have been provided in a variety of forms heretofore, some of which will be discussed below to the extent that they are relevant to the present invention. In general, it may be mentioned that practically all such systems comprise an insulating body previously formed with conductive elements in spaced-apart relation, the conductors previously stripped of insulation, being connected to these elements so as to form a good electrical contact therewith. Good electrical contact is important in the power field so as to avoid potential drops and contact heating and in the electronic and information-processing field to avoid noise and perturbations of the various signals. Good electrical contact is associated with an adequate pressure between the conductive element and the barred end of the wire and an effective surface contact between the two.

Terminal strips have been provided heretofore in the form of insulating blocks into which screws were threaded to form all or part of the conductive element at each station, the blocks being also provided with passages running at right angles to the screw into which the end of the wire could be inserted. When the screw is tightened, it presses the wire against a surface juxtaposed with the tip of the screw, thereby clamping the wire in place and generating the necessary contact pressure and surface contact for effective conduction. Thus, in such conventional terminal strips, the passage for insertion of the wire and the chamber for passage in which the screw is disposed and displaced lie at right angles to one another.

Such systems have been found to require a relatively large space since the conductors or wires must be inserted from the side and even if they are bent at right angles to reduce the lateral space requirements, the systems occupy a considerable volume when viewed in terms of the space required for insertion and removal of the wires and the space occupied by the terminal strip itself. Frequently, a terminal strip must be disposed along an edge of a housing, e.g. a circuit breaker box, and lateral space is therefore at a premium. Even the manipulation of such terminal strips may be fraught with difficulty if large numbers of wires must be inserted laterally in a minimum of space.

It has been proposed to avoid some of these disadvantages, especially where a large number of conductors must be attached in a limited area, i.e. in a system of having high conductor density, by the use of other types of terminals.

For example, the aforementioned conductive elements of the terminal strips may be posts about which the bared end of the wire is coiled by the so-called wire-wrap process. This system uses a tool for twisting the end of the wire in a multiplicity of turns tightly around the post. The pressure is a result of the tightness of the coiling operation and the large number of turns ensures an adequate contact surface. In another such system, referred to as the TERMI-point system, the wire, as in the wire-wrap system can lie practically parallel to the conductive element. Both of these systems have the advantage that practically no lateral space is required in addition to that occupied by the terminal strip.

However, these systems have a disadvantage in that the space occupied by each post and the associated wire can be relatively large and this may make manipulation (i.e. connection and disconnection) difficult where a high-conductor density is required.

Mention may also be made of systems in which the screw and the wire are substantially parallel to one another in terminal blocks, strips or devices. These systems, however, also have the disadvantage that they are not always suitable for use when a high terminal density is desirable and also occupy considerable space. As a result, such systems have not found widespread usage in practice.

OBJECTS OF THE INVENTION

It is the principal object of the present invention to provide an electrical terminal device for the improved connection of a wire to another unit whereby the disadvantages of the earlier systems are avoided.

A more specific object of the invention is to provide an improved terminal device using screw-type conductive elements in which the wire or conductor extends generally in the same direction as the screw so that the advantage of the wire-wrap or TERMI point systems are obtained, but wherein the system is free from the disadvantages of earlier terminal arrangements using screw-type clamping of the wire.

Still another object of the invention is to provide an improved terminal strip for high-terminal densities and effective connection between a multiplicity of conductors and respective conductive elements.

SUMMARY OF THE INVENTION

These objects and others which will become apparent hereinafter are attained, in accordance with the present invention, in a terminal device that comprises a body of electrically insulating material provided with a passage for the conductor or wire and a passage into which a screw can be tightened, the conductor passage being inclined at an acute angle to the screw passage and at least in part merging therewith. According to a feature of the invention, the screw passage can have a frustoconical portion at which the merger is effected while the screw has a frustoconical portion adapted, when the screw is tightened, to clamp against the end of the wire exposed to the screw passage within the wire passage.

When the block or body is prismatic, both passages can open at the same face of the body.

The conductor compartment or passage into which the wire is inserted and the receiving compartment or passage into which the contact screw is threaded can open externally close to one another so that each terminal unit formed by the two passages and the screw occupies a relatively small space. The screw is loosened, i.e. partly retracted, to permit insertion of the wire which is then inserted into the conductor passage, whereupon the screw is tightened. The wire is thereby clamped against the frustoconical portion of the screw and runs practically parallel to the screw axis. Advantageously, the wire axis within its passage and hence the axis of the wire axis passage itself includes an angle with the screw compartment or passage which is from 5° to 15°. The wire is clamped against the surface of the wire passage juxtaposed with the screw at the merger region and is held tightly in place.

The clamping of electrical conductors by screw action has been found to give rise to various problems which characterized most of the prior-art devices. For example, the individual strands of the wire may be of relatively small thickness so that the wire to be clamped may be assembled from a plurality or multiplicity of strands. When such stranded wires are engaged by clamping screws in conventional terminal devices, it is found that the tip or threaded portion of the screw destroys or damages the stranded wire so that the latter cannot be effectively reused. In addition, strands which break off from the wire during the tightening of the clamping screw may remain within the terminal block and interfere with reuse of the latter.

This problem is completely eliminated in the system of the present invention when the frustoconical portion of the screw is constituted as a smooth-surfaced unthreaded body which tapers or converges toward the threaded end of the screw and is provided as the screw head or between the head and the threaded portion of the screw. In this case, the tightening of the screw effects a clamping action which is practically free from transverse shearing effect upon the screw so that damage to the wire, kinking thereof or breakage of the strands of the wire does not occur. The clamped end of the wire can be reused, fragments of wire do not remain in the wire passage, and a high surface pressure can be generated for effective electrical contact.

As has been stated heretofore, the clamping portion of the screw is a conical thread-free portion which preferably has a half angle equal to the angle included between the axis of the wire passage and the axis of the screw passage. Of course, the clamping portion of the screw should taper in the direction in which the wire passage converges toward the screw passage and also in the direction of the threaded portion of the screw. The insulating body or block can be formed below the region in which the passages merge, with an internally threaded member which can be engaged by the threaded portion of the screw.

According to yet another feature of the invention, an unthreaded cylindrical portion of the screw is provided between the frustoconical portion and the threaded portion and, advantageously, has a diameter less than the outer diameter of the threaded portion and equal to the small diameter of the frustoconical portion.

According to yet another feature of the invention, the screw has a cylindrical end portion, tightly guided in a cylindrical part of the screw passage or bore, between the head of the screw and the frustoconical portion. This latter cylindrical portion can have a diameter equal to the large diameter of the frustoconical portion which large diameter may be greater than the outer diameter of the threaded portion. The head or end of this cylindrical portion can be provided with a formation, e.g. a slot or socket, engageable by a screwdriver or Allen wrench to permit turning of the screw.

Advantageously the screw should be recessed within the screw passage and below the mouth of the latter when the screw is tightened to clamp the wire.

A terminal device, according to the invention, can be used for many purposes. For example, it can be used to connect electrical conductors together and to connect a number of electrical conductors with respective electrical conductors or a single electrical conductor. It also may be used to connect incoming and outgoing conductors with electrical units.

When the conductor running to a further unit such as a spring, prong, clip, lug or fork is provided, a leg of this contact may reach into the wire passage to form the surface juxtaposed with the conical portion of the screw so that the wire is clamped against this leg. This provides a form-fitting forced-contact between the wire and the member to which it is to be electrically connected directly. Alternatively, the further member may be connected to a block formed with the passages and into which the screw is threaded, this block being formed as metal so that it constitutes the connection between the wire and the other member. When the block is composed of an insulating material, the aforementioned direct contact between the wire and a leg of the further member is preferably used.

According to another feature of the invention, the aforementioned blocks are of prismatic shape with the passages opening at one end face of the block. These blocks may, in turn, be received in closely spaced relationship in respective compartments of an electrically insulating strip or may be held together in the form of a terminal strip by electrically insulated material cast, injection-molded or otherwise applied between the blocks.

The aforedescribed arrangement in which a leg of a further contact member reaches into the wire passage and is clamped against the wire has the further advantage that it allows these contact members to be removed and replaced when the screw is loosened.

According to still a further feature of the invention, a plurality of wire passages are provided for each block so that a number of individual wires can be clamped by each screw.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
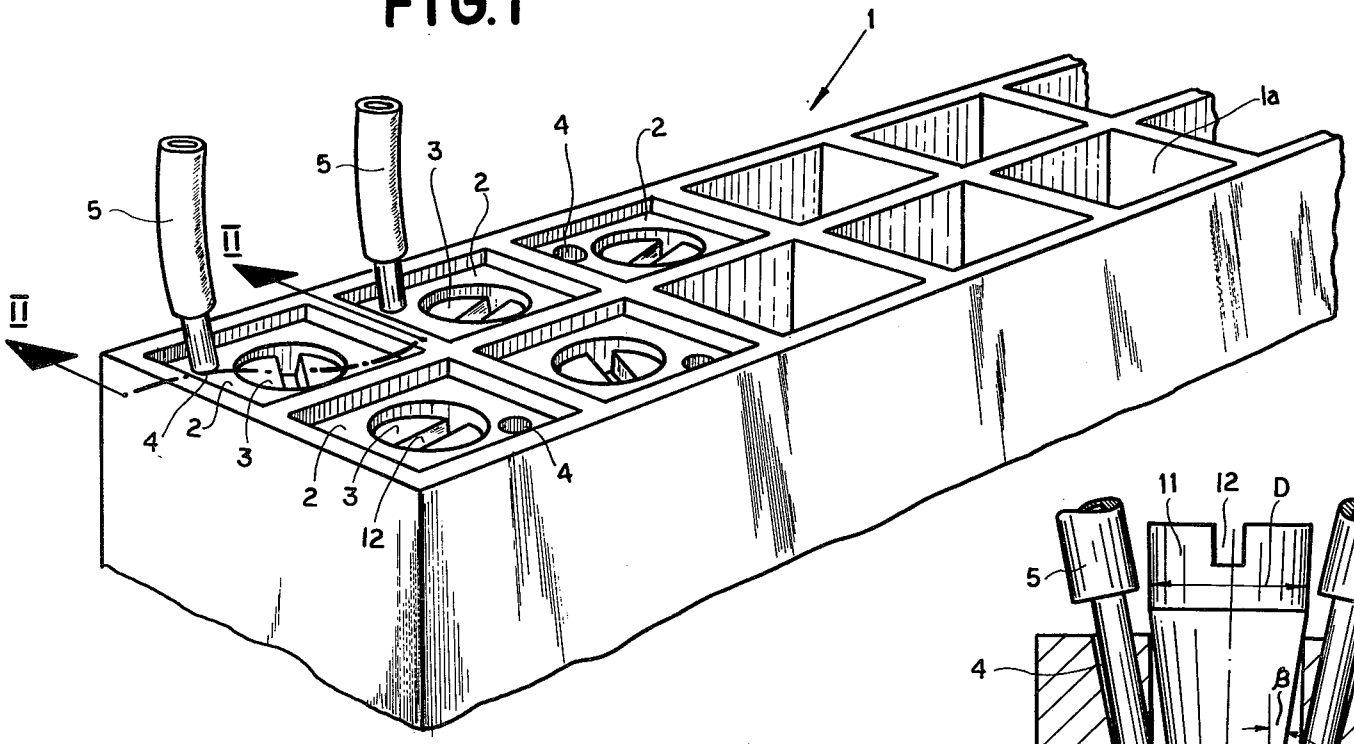
FIG. 1 is a diagrammatic perspective view of a terminal strip according to the invention.
Figure 2:
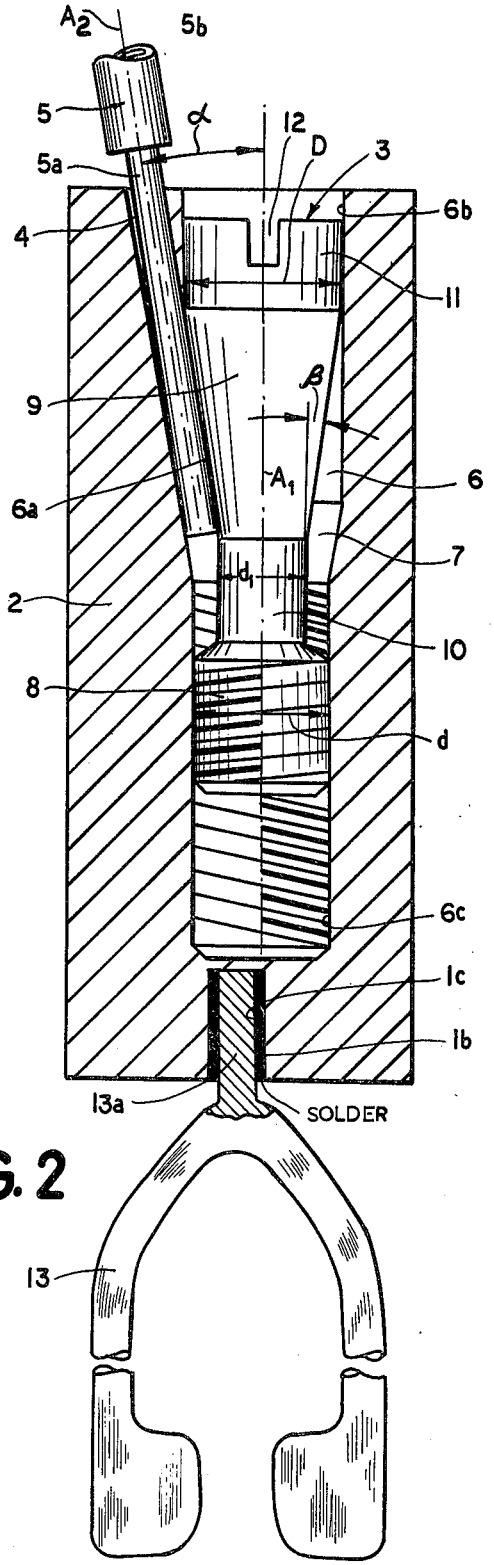
FIG. 2 is a cross-sectional view taken along the line II—II of FIG. 1, drawn to an enlarged scale.

The terminal device shown in FIGS. 1 and 2 comprises an insulating strip 1 provided with a multiplicity of compartments 1*a* here shown to be of square cross-section, each adapted to receive a number of electrically conductive terminal blocks 2 of square cross-section and, generally, prismatic configuration. The blocks 2 can be composed of electrically conductive material, e.g. copper or aluminum or alloys thereof, and may be connected as shown in FIG. 2 to spring forks 13 forming plug or socket connectors for other electrical units by soldering at 1*b* a shank 13*a* of the member 13 in a bore 1*c* of the block 2.

Each block 2 is provided with a central bore 6 for a screw 3 which serves to clamp a bore 5 to the block 2.

In the embodiment illustrated, the wire 5 has its insulation 5*b* moved over the length of a bare portion 5*a* which is received in a wire passage 4. The axis $A_1$ of the screw passage includes an angle $\alpha$ with the axis $A_2$ of the wire passage.

Figure 3:
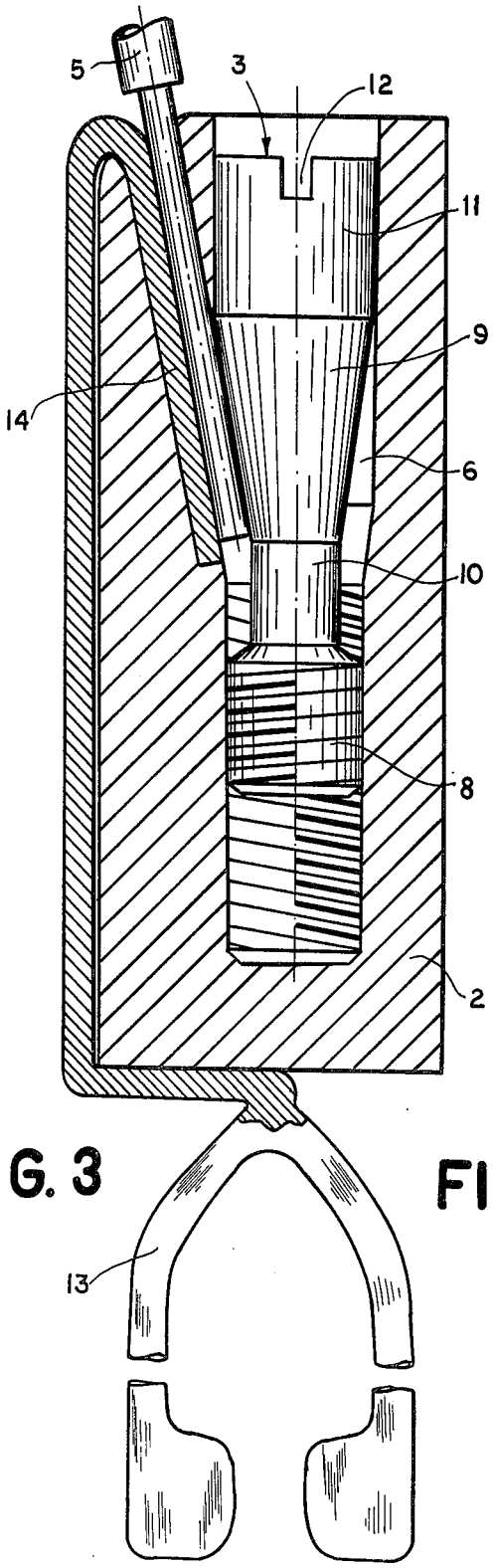
FIG. 3 is a cross-sectional view similar to FIG. 2 but illustrating another embodiment of the invention.

As has been shown in both FIGS. 2 and 3, the wire passage 4 forms an acute angle $\alpha$ with the screw passage and the two passages merge with one another in a region 6*a* corresponding to a conical transition region 7 of the bore 6. The bore 6 may have a cylindrical guide portion 6*b* extending to the conically tapering transition portion 7 and terminating in a threaded anchored portion 6*c*.

The screw 3 has a threaded portion 8 whose diameter d is more than the diameter $d_1$ of a cylindrical portion 10 and the diameter of the anchored end of the frustoconical thread-free clamping portion 9. The latter has a large diameter end which is extended by a cylindrical guide portion 11 of the screw, the latter having a diameter D which is greater than the diameter d previously mentioned. The cylindrical guide portion 11, which is snugly received in the cylindrical portion 6*b* of the bore 6, is formed with a slot 12 to accommodate the blade of a screwdriver. The screw can be, of course, as is evident from FIGS. 2 and 3, fully recessed in the bore 6.

The further contact members can, as has been shown for FIG. 3, be provided with legs 14 which reach into the passage 4 and have the wire 5 clamped thereagainst by the screw. This allows replacement of these contact members when the screw is released.

Figure 4:
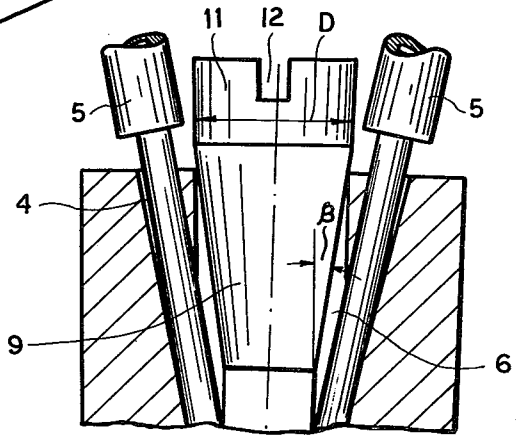
FIG. 4 is a partial cross-sectional view similar to FIG. 2 but illustrating another embodiment of the invention.

FIG. 4 is a fragmentary view showing how two or more wires can be accommodated in a terminal device of the present invention. In this case a plurality of passages 4, 4' are angularly equispaced about the axis of the passage and receive respective wire ends 5*a* and 5*a*' which are clamped when the screw 3 is tightened. In all of the embodiments illustrated, the taper (conical half angle) $\beta$ of the clamping portion of the screw is equal to the angle $\alpha$ previously mentioned.

I claim:

1. A terminal strip comprises:

an insulating body provided with a plurality of compartments open along a side of said body; and a respective contact device received in each of said compartments, each such device comprising:

a block of electrically conductive material having a face exposed along said side of said body, a screw-receiving passage formed in each of said blocks and open at the respective face thereof, each screw-receiving passage being formed with a cylindrical guide portion of relatively large diameter, a frustoconical transition portion extending from said guide portion, and an internally threaded portion of reduced diameter, at least one wire passage formed in each of said blocks, open at the respective said face thereof and converging toward the respective screw-receiving passage and merging therewith in the respective transition portion, said wire passages being each adapted to receive a respective wire of a conductor, a respective screw threadedly received in each of said blocks for clamping the respective wire in the respective wire passage, each screw being formed with a threaded portion engaging the threaded portion of the screw-receiving passage, a nonthreaded frustoconical clamping portion having a conical half angle equal to the angle included between the passages of the respective blocks, and a cylindrical head formed with means for rotating the screw, said cylindrical head being guided in said guide portion of the screw-receiving passage, and a contact member connected to the respective block.

2. The terminal strip defined in claim 1, further comprising a respective cylindrical connecting portion between each threaded portion and clamping portion of the respective screw.

3. An electric terminal device comprising a body formed with a screw passage and with a wire passage converging toward and merging with said screw passage, said body having a face at which both said passages open close to one another, said wire passage being adapted to receive an electric conductor, and a screw threadedly received in said body and disposed in said screw passage for clamping said wire in said body, said screw having a cylindrical thread-free guide portion accessible to enable rotation of said screw, a conical thread-free clamping portion intermediate said guide portion and the opposite end of said screw, and a threaded portion at said opposite end of said screw, said conical portion converging toward said threaded portion and said passages including an acute angle between them.

4. The device defined in claim 3 wherein said guide portion has a diameter greater than the outer diameter of said threaded portion.

5. The device defined in claim 3 wherein said screw passage has a conical transition region, said screw and wire passages merging at said transition region.

6. The device defined in claim 3, further comprising a contact member for electrically connecting said wire to another unit and having a leg reaching into said wire passage and against which the wire is adapted to be placed by said screw.

7. The device defined in claim 3 wherein the angle included between said wire and screw passages is 5° to 15°.

8. The device defined in claim 3 wherein said body is formed with a plurality of wire passages each adapted to receive a wire to be clamped by said screw.

9. The device defined in claim 3 wherein said screw has a cylindrical connecting portion between said frustoconical portion and said threaded portion.

10. The device defined in claim 9, further comprising a contact member for connection to an electrical unit, said contact member being conductively connected to said body.

* * * * *